United States Patent [19]

Coll-Tortosa

[11] Patent Number: 4,581,886

[45] Date of Patent: Apr. 15, 1986

[54] TWIST PRODUCING DEVICE

[75] Inventor: Liberto Coll-Tortosa, Sabadell/Barcelona, Spain

[73] Assignee: W. Schlafhorst & Co., Moenchengladbach, Fed. Rep. of Germany

[21] Appl. No.: 694,420

[30] Foreign Application Priority Data

Jan. 25, 1984 [DE] Fed. Rep. of Germany .... 3402460

[22] Filed: Jan. 24, 1985

[51] Int. Cl.[4] ..... D02G 1/04; D02G 1/16; D01H 7/92; D01H 5/28

[52] U.S. Cl. ..... 57/333; 28/274; 57/328

[58] Field of Search ..... 57/328, 337, 350; 28/271–276

[56] References Cited

U.S. PATENT DOCUMENTS

| | | | |
|---|---|---|---|
| 3,204,396 | 9/1965 | Foster et al. | 57/333 X |
| 3,477,218 | 11/1969 | Hawtin et al. | 57/333 X |
| 3,910,021 | 10/1975 | Van Petten | 57/333 X |
| 4,141,121 | 2/1979 | Trifunovic | 57/333 X |
| 4,219,998 | 9/1980 | Farnhill | 57/333 X |
| 4,480,434 | 11/1984 | Hiroshi et al. | 57/350 X |
| 4,480,435 | 11/1984 | Anahara et al. | 57/350 X |

*Primary Examiner*—John Petrakes

*Attorney, Agent, or Firm*—Herbert L. Lerner; Laurence A. Greenberg

[57] ABSTRACT

A twist producing device for a thread-shaped textile product moving in the longitudinal direction thereof includes a housing with a thread inlet side, a thread channel formed at the thread inlet side of the housing having a given open cross-sectional area permitting passage of a thread, an expansion chamber disposed in the housing downstream of the thread channel in the longitudinal direction having an open cross-sectional area being larger than the given area and defining an outer wall, an annular pre-expansion chamber with an open cross-sectional area formed in the housing surrounding the thread channel and defining an outer wall coextensive with the outer wall of the expansion chamber, means formed in the housing for supplying compressed air, and at least one air injection orifice with an open cross-sectional area leading from the compressed air supply means and discharging tangentially into the pre-expansion chamber, the compressed air supply means, the open cross-sectional area of the air injection orifice and the open cross-sectional area of the pre-expansion chamber being proportioned to each other causing air to impinge with supersonic velocity onto parts of the thread-shaped textile product passing in vicinity of the pre-expansion chamber.

2 Claims, 2 Drawing Figures

TWIST PRODUCING DEVICE

SPECIFICATION

Figure 1:
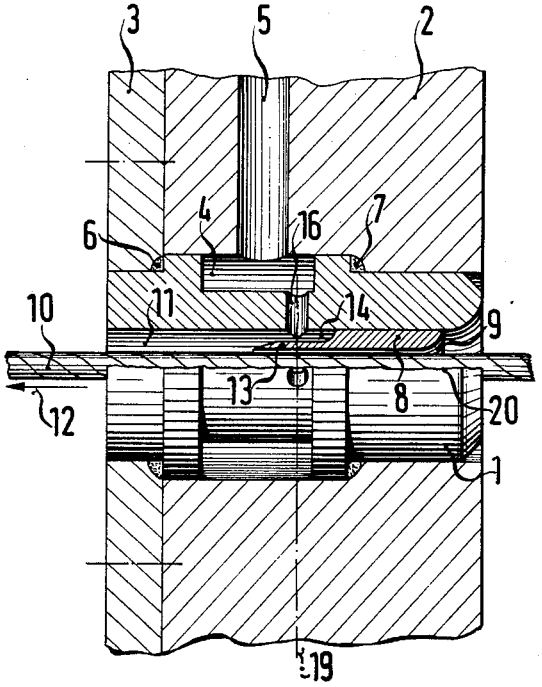

The invention relates to a twist producing device for a textile product in the form of a thread moving along the longitudinal direction thereof, including a thread channel having a given open cross-sectional area disposed at the inlet side of the twist producing device permitting the passage of a thread, and an expansion chamber downstream of the thread channel having a larger open cross-sectional area and being supplied with compressed air.

In a twist producing device of this type, the compressed air normally enters the expansion chamber at the speed of sound and expands in the chamber to the pressure of the surrounding environment. In some cases, the air is guided in a spiral path, thereby impinging on the outer parts of the moving thread-like textile product with a speed below the speed of sound. In order to obtain a thread-twisting effect, the angular velocity of the air turbulence in the expansion chamber and therefore the yarn-twisting effect itself becomes greater, as the chosen diameter of the expansion chamber becomes smaller.

On the other hand, care must be taken to prevent a back-flow of air through the thread channel, because in this case the slivers, which may be formed of spinning fibers, for example, might break. In order to avoid this condition, suction must be provided at the inlet of the thread channel. This requires a very strong negative pressure at the discharge of the thread channel into the expansion chamber relative to the surrounding pressure or atmospheric pressure, which in turn requires that the free cross-sectional area of the expansion chamber be many times greater than the sum of the free cross-sectional areas of the injection orifices or nozzles through which the air flows into the expansion chamber. However, enlarging the expansion chamber results in a reduction of the torsional moment applied to the thread. If the air injection orifices are directed in such a way that they almost point to the central axis of the twist producing device, additional difficulties are encountered. This is because in this case the textile product is directly impinged by the air jets, and very little or no negative pressure can exist at that critical point.

For the above-mentioned reasons, a twisting device constructed in the conventional way can at best be a compromise between a yarn torsion which is too small and a pressure difference between the obtainable negative pressure and the atmospheric pressure which is too small, so that the results are generally unsatisfactory.

It is accordingly an object of the invention to provide a twist producing device which overcomes the hereinafore-mentioned disadvantages of the heretofore-known devices of this general type, and to create an extremely effective twist producing device which is capable of producing yarn with a false twist, or texture-like effects in the thread with great speed.

With the foregoing and other objects in view there is provided, in accordance with the invention, a twist producing device for a thread-shaped textile product moving in the longitudinal direction thereof, comprising a housing with a thread inlet side, a thread channel formed at the inlet side of the housing having a given open cross-sectional area permitting passage of a thread, an expansion chamber disposed in the housing downstream of the thread channel in the longitudinal direction having an open cross-sectional area being larger than the given area and defining an outer wall, an annular pre-expansion chamber with an open cross-sectional area formed in the housing surrounding the thread channel and defining an outer wall coextensive with the outer wall of the expansion chamber, means formed in the housing for supplying compressed air, and at least one air injection orifice with an open cross-sectional area leading from the compressed air supply means and discharging tangentially into the pre-expansion chamber, the compressed air supply means, the open cross-sectional area of the air injection orifice and the open cross-sectional area of the pre-expansion chamber being proportional to each other causing air to impinge with supersonic velocity onto parts of the thread-shaped textile product passing in vicinity of the pre-expansion chamber.

Due to the feature that the air contacts the thread-shaped textile product with supersonic speed, and yet in such a way that the fiber formation is not destroyed or even deteriorated, it becomes possible to obtain a twisted or textured thread or yarn with great production speed.

In accordance with another feature of the invention, the at least one air injection orifice or orifices have a total open cross-sectional area being smaller than the open cross-sectional area of the pre-expansion chamber. In this way, the air flows with increased supersonic velocity through the pre-expansion chamber. This high velocity air speed enhances the formation of the spiral-shaped air turbulence in the pre-expansion chamber, which leaves the pre-expansion chamber with supersonic velocity.

In accordance with a concomitant feature of the invention, the at least one air injection orifice or orifices are disposed in an imaginary plane perpendicular to the longitudinal axis of the thread channel. Due to the construction, the torsion moment with respect to the yarn and the angular velocity of the tangential component of the flowing air, are maximized.

Other features which are considered as characteristic for the invention are set forth in the appended claims.

Although the invention is illustrated and described herein as embodied in a twist producing device, it is nevertheless not intended to be limited to the details shown, since various modifications and structural changes may be made therein without departing from the spirit of the invention and within the scope and range of equivalents of the claims.

Figure 2:
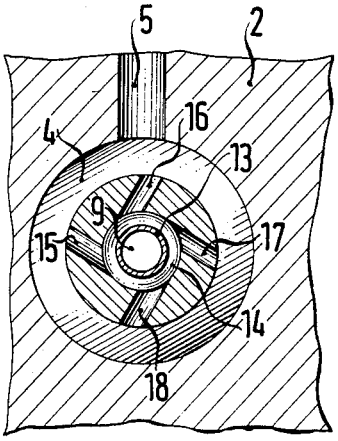

The construction and method of operation of the invention, however, together with additional objects and advantages thereof will be best understood from the following description of specific embodiments when read in connection with the accompanying drawings, in which:

FIG. 1 is a fragmentary, diagrammatic, partially longitudinal-sectional view of a twist producing device according to the invention which is installed in position; and FIG. 2 is a fragmentary cross-sectional view of the twist producing device shown in FIG. 1.

Referring now in particular to the two figures of the drawings in detail, it is seen that a twist producing device 1 is inserted in a housing 2 which is covered by a cover 3. An annular groove 4 is disposed around the twist producer 1 and is connected to a supply channel 5 for compressed air. Ring seals or circumferential joints 6, 7 prevent the escape of the compressed air in the annular groove 4.

The twist producing device 1 is made on a lathe and is consequently constructed in the form of a turned, machined part. The twist producing device is provided with a central bore. An insert 8 with a special shape is fitted into the bore, so that a thread channel 9 is formed at the inlet side with a smaller open cross-sectional area which just permits the passage of a thread 10. An expansion chamber 11 is formed directly adjacent the thread channel 9 by the remaining exposed part of the central bore. The end of the insert 8 is provided with a neck portion 13 as seen in the direction of the thread motion 12, so that an annular pre-expansion chamber 14 is formed around the neck portion. The outer wall of the pre-expansion chamber 14 continues into the outer wall of the expansion chamber 11. This is accomplished in a simple manner because both walls are parts of the outer wall of the central bore.

According to FIG. 2, four air injection orifices or nozzles 15, 16, 17, 18 lead from the annular groove 4 tangentially into the pre-expansion chamber 14. All of the injection orifices lie in one plane, which in this case is identical with the cross-sectional plane 19. The section plane 19 cuts the longitudinal axis 20 of the thread channel 9 perpendicularly. The axis 20 is at the same time the common longitudinal axis of the twist producing device 1. The sum of the effective cross sections of the air injection orifices 15 to 18 is smaller than the effective cross section of the pre-expansion chamber 14, so that air with increased supersonic velocity flows through the pre-expansion chamber 14.

The supply channel 5 for the compressed air is connected to a non-illustrated compressed air source having adjustable pressure, so that air pressure up to 10 bar can be produced in the annular groove 4.

The invention is not limited to the illustrated and described specific embodiment used as an example.

I claim:

1. Twist producing device for a thread-shaped textile product moving in the longitudinal direction thereof, comprising a housing with a thread inlet side, a thread channel formed at said inlet side of said housing having a given open cross-sectional area permitting passage of a thread, an expansion chamber disposed in said housing downstream of said thread channel in said longitudinal direction having an open cross-sectional area being larger than said given area and defining an outer wall, an annular pre-expansion chamber with an open cross-sectional area formed in said housing surrounding said thread channel and defining an outer wall coextensive and coplanar with said outer wall of said expansion chamber, means formed in said housing for supplying compressed air, and at least one air injection orifice with an open cross-sectional area leading from said compressed air supply means and discharging tangentially into said pre-expansion chamber, said at least one air injection orifice being disposed in a plane perpendicular to the longitudinal axis of said thread channel, said compressed air supply means, said open cross-sectional area of said air injection orifice and said open cross-sectional area of said pre-expansion chamber being proportioned to each other causing air to impinge with supersonic velocity onto parts of the thread-shaped textile product passing in vicinity of said pre-expansion chamber.

2. Twist producing device according to claim 1, wherein said at least one air injection orifice has a total open cross-sectional area being smaller than said open cross-sectional area of said pre-expansion chamber.

* * * * *